United States Patent [19]

Ehiro et al.

[11] Patent Number: 4,550,582

[45] Date of Patent: Nov. 5, 1985

[54] METHOD OF PRODUCING STEEL H-SHEET PILE

[75] Inventors: Takashi Ehiro; Teruaki Tanaka; Eisuke Yamanaka, all of Kurashiki, Japan

[73] Assignee: Kawasaki Steel Corporation, Hyogo, Japan

[21] Appl. No.: 436,993

[22] Filed: Oct. 27, 1982

Related U.S. Application Data

[63] Continuation-in-part of Ser. No. 229,111, Jan. 28, 1981, abandoned.

[30] Foreign Application Priority Data

Feb. 4, 1980 [JP] Japan ..... 55-12222
Feb. 4, 1980 [JP] Japan ..... 55-12223
Feb. 19, 1980 [JP] Japan ..... 55-19589

[51] Int. Cl.[4] ..... B21B 1/10; B21B 13/08
[52] U.S. Cl. ..... 72/234
[58] Field of Search ..... 72/178, 179, 177, 182, 72/221, 234, 235; 29/155 R; 405/277, 278; 52/579, 729

[56] References Cited

U.S. PATENT DOCUMENTS 4,086,801 5/1978 Nakajima et al. ..... 72/234

FOREIGN PATENT DOCUMENTS 11061 1/1979 Japan ..... 72/234

*Primary Examiner*—E. Michael Combs
*Attorney, Agent, or Firm*—Koda and Androlia

[57] ABSTRACT

A method of producing a steel H-sheet pile from a beam blank of an H-shape cross section, symmetrical in the vertical and lateral directions, and prepared through blooming rolling or continuous casting including a first step wherein a breakdown mill having a preparatory step forming caliber and a forming caliber is used to form the beam blank in such a manner that in the preparatory step forming caliber the beam blank is changed into an asymmetrical shape in the vertical direction and subsequently, in the forming caliber, the beam blank is rolled to have a socket and projections; a second step wherein a group of roughing universal mills is used to roll the beam blank in such a manner that in a roughing universal mill mainly the web and flanges are reduced in thickness while in a sizing universal mill the outer surfaces of the flanges are pressed by vertical slots thereof while the end portions of the flanges are sized-rolled by horizontal rolls thereof; a third step wherein a joint portion at the end portion of the flange is subjected to bending between a first roller having a projection for defining a bending position of said joint portion and a second roller having a projection for bending the joint portion and a fourth step wherein a finishing universal mill is used to finish-roll the beam blank to provide the steel H-sheet pile.

4 Claims, 20 Drawing Figures

METHOD OF PRODUCING STEEL H-SHEET PILE

This is a continuation-in-part of application Ser. No. 229,111, filed 1-28-81, abandoned.

BACKGROUND OF THE INVENTION

1. Field of the Invention

The present invention relates to a method of producing an integral type steel H-sheet pile.

2. Description of the Prior Art

There has been a long-felt need of providing sheet piles having a high section modulus, water leakage preventiveness and workability due to an increase of civil engineering work for construction of revetment, quay wall, landslide protection, temporary cofferdam or the like. To meet this necessity, heretofore, there have been provided various sheet piles in which joint members are welded to steel piles and various shaped steels each having a large cross section. However, processes for separately producing the main bodies of sheet piles and joint members, and processes for welding the joint members to the main bodies of sheet piles are required for producing these sheet piles, thereby increasing production costs.

Then, there have been proposed steel sheet piles of various cross sections to be produced only by a rolling process in which the main body of sheet pile is integrally formed with joint members. Among those steel sheet piles, one which can easily have a high section modulus and can be rolled with a high efficiency is a steel sheet pile being of an H shape in cross section and having joint portions, which engage joint members of adjacent sheet piles with each other, respectively. The joint members are formed at each end of a pair of flanges opposed with respect to the center line of the H-sheet pile in cross section.

Now, as disclosed in Japanese Patent Kokai(Laid-Open) No. 11061/79 for example, the conventional method for producing steel H-sheet pile has been the method wherein a beam blank having a desirable cross section, being asymmetrical in the vertical and lateral directions is used in blooming rolling or continuous casting. Since an ordinary H-shaped beam blank cannot be utilized, a blooming rolling or continuous casting process has been required exclusively for the method, thereby presenting the disadvantages that the process is complicated and a high installation cost is required.

Furthermore, heretofore, there has been adopted a process in which a group of universal mills consisting of a roughing universal mill and a roughing sizing mill perform reciprocating rolling for a plurality of passes. However, in the conventional method, as the roughing sizing mill, two-high caliber rolls have been used, thereby presenting the disadvantages that flanges are liable to fall and the shape of joint portions is produced with low accuracy.

Since the bending of the joint portions has been performed by means of two-high caliber rolls, the disadvantage that malformation of the joint portions is liable to occur also exist.

As described above, in the method of producing the steel H-sheet pile of the prior art, there have been encountered various problems in rolling which hamper efficient and highly accurate production of the steel H-sheet pile.

SUMMARY OF THE INVENTION

The present invention has been developed to obviate the abovedescribed problems and has as its object the provision of a method of solving the various problems in rolling for efficiently and highly accurately producing the steel H-sheet pile and the like by means of a group of universal mills.

According to the present invention, in a method of producing a steel H-sheet pile from a beam blank having an H-shape in cross section being symmetrical in the vertical and lateral directions obtainable through blooming rolling or continuous casting, the method includes a first step of rolling a beam blank into an H-shaped beam blank having a socket and projections corresponding to two projecting members forming a finger joint portion at the end of a flange; a second step wherein a group of roughing universal mills consisting of a roughing universal mill and a sizing universal mill is used wherein in the roughing universal mill the web thickness and flange thickness are mainly reduced and wherein the sizing universal mill the outer surfaces of the flanges are pressed by vertical rolls thereof while the end portions of flanges are size-rolled by horizontal rolls thereof and rolling by the both mills is repeated for a plurality of passes; a third step of bending a joint portion between a first roller having a projection for positioning a bending position of the joint portion at the end of the flange and a second roller having a projection for bending the joint portion; and a fourth step of finish-rolling by a finishing universal mill to thereby produce a steel H-sheet pile.

It is preferable that the beam blank is rolled by the preparatory step forming sections into a cross-sectional shape having such a ratio in area between the web and the flanges such that the web and the flanges have substantially the same elongation ratios in the succeeding forming calibers.

Additionally, it is preferable that, in the roughing universal mill, such rolling is performed that the elongation ratio of the flanges is high first and then progressively lowered, whereby the flow of the metal in the widthwise direction of the flanges is facilitated, so that rolling of the joint portion can be performed with high accuracy.

According to the aforesaid Japanese Patent Kokai(-Laid-Open) No. 11061/79, the beam blank is subjected to a roughing universal rolling by the universal mill and a two-high caliber rolls (sizing mill), and thereafter, the shape of the beam blank is size-rolled by an intermediate universal mill and an intermediate sizing mill, and then, the beam blank is fed to a finishing universal mill. In contrast thereto, according to the present invention, a rolling stand consisting of the roughing universal mill is used as described above, so that an accurate and satisfactory shape of the beam blank can be obtained without rolling by an intermediate universal mill as seen in the reference cited.

Furthermore, according to the invention of the present application, a beam blank being symmetrical in the vertical and lateral directions, i.e., an ordinary H-shaped beam blank, can be utilized as being a blank, whereby no large installations are needed exclusively for blooming rolling or continuous casting, so that the installation cost can be reduced to a considerable extent.

Further, according to the invention of the present application, a universal mill is used as the roughing sizing mill, so that the flanges can be reliably prevented from falling during sizing, thus enabling the rolling of the flange portions and the joint portions into the desired shapes with high accuracy.

Moreover, according to the present invention, an exclusive joint portion bending device having rollers for defining the bending positions and rollers for bending is provided directly in front of the finishing universal mill, so that forming of the joint portions with high accuracy can be performed only if a simple device is added.

Furthermore, the provision of the joint portion bending device for performing only the bending of the joint portion as described above can eliminate the necessity for providing the intermediate sizing mill in the reference cited. In consequence, according to the present invention, rolling can be performed using an installation having fewer in smaller number stands (by two stands) than those in the reference cited. Additionally, in comparison between the preparatory step bending of fingers in the intermediate sizing mill in the reference cited and the joint portion (i.e., finger) bending device according to the present invention, the present invention can perform finger bending sizing with higher accuracy and lower installation cost than the reference cited.

BRIEF DESCRIPTION OF THE DRAWINGS

The above-mentioned features and objects of the present invention will become more apparent with reference to the following description, taken in conjunction with the accompanying drawings, wherein like reference numerals demote like elements, and in which.

DETAILED DESCRIPTION OF THE INVENTION

Description will hereunder be given of the embodiments of the present invention with reference to the present invention.

Figure 1:
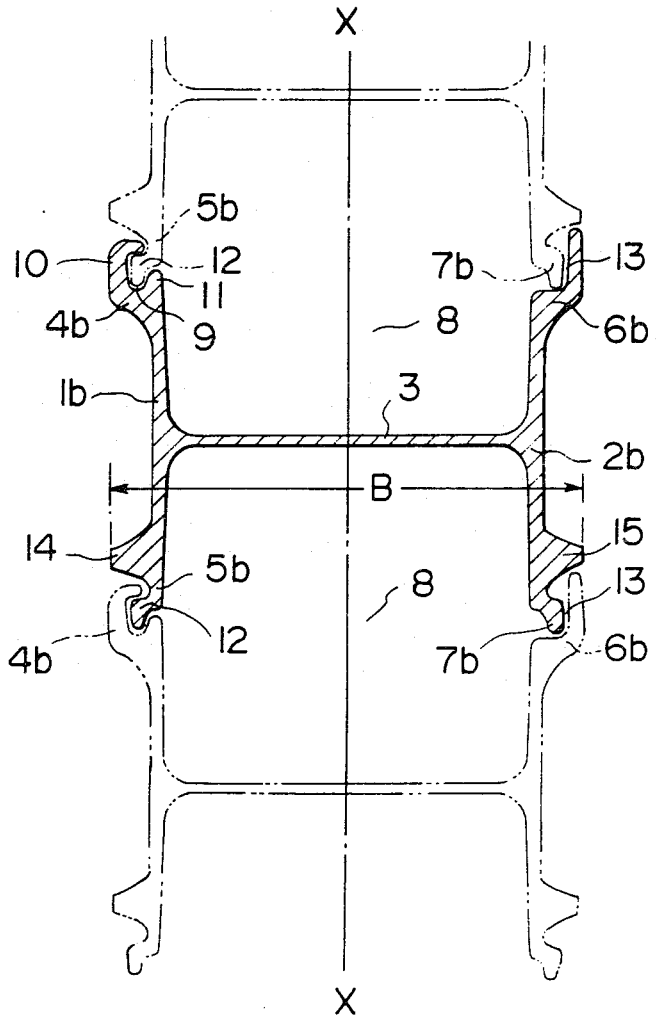
FIG. 1 is a sectional view showing an embodiment of a steel H-sheet pile obtained by working the present invention.
Figure 2:
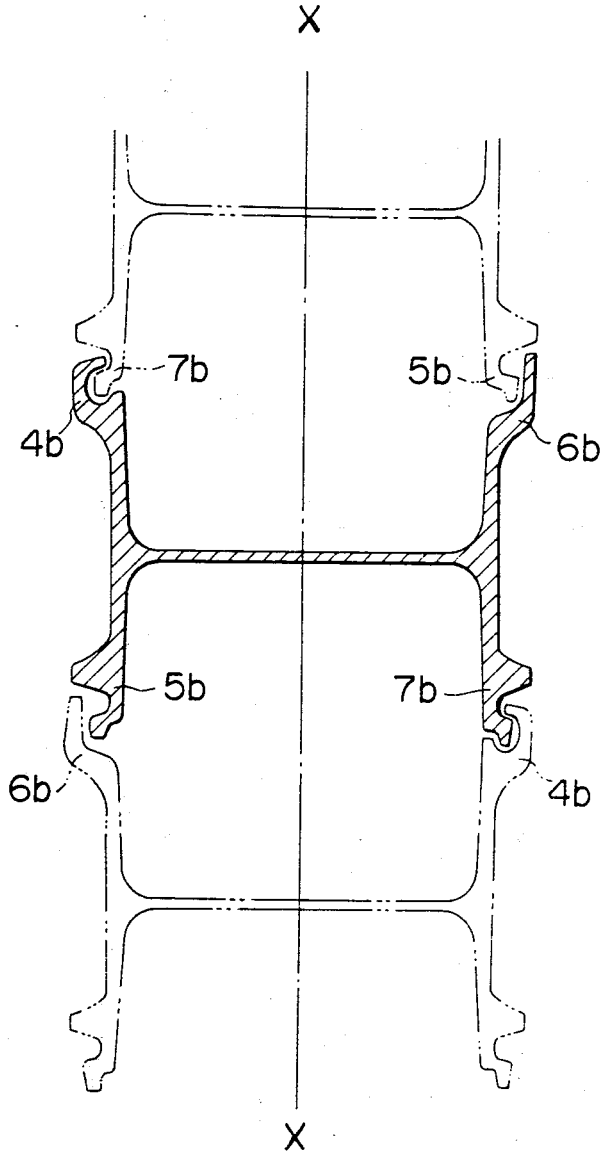
FIG. 2 is an explanatory view showing the state where the steel H-sheet piles shown in FIG. 1 are arranged in an alternately overturned fashion.

Firstly, FIG. 1 shows an embodiment of the cross section of the steel H-sheet pile produced according to the present invention. Among joint portions *4b, 5b* and *6b, 7b* disposed at each end of flanges *1b, 2b* opposed with respect to the center line X—X of the H-sheet pile 8 in cross section, a pair of joint portions *4b, 5b* are formed into finger joint portions to be coupled to each other. More particularly, the joint portion *4b* is formed with a socket 9 formed between projecting pieces corresponding to the so-called finger and thumb 10, 11, and the other joint portion *5b* is formed with a ball end 12 to be coupled to the socket 9. Thus, the socket 9 of one sheet pile is coupled to the ball end 12 of the adjacent sheet pile, which is repeated successively, thereby forming a wall of sheet piles. As for the other pair of joint potions *6b, 7b,* in FIG. 1 for example, the inner surface of the joint portion *6b* is overlapped on the outer surface of the joint portion *7b* with a gap 13 being held therebetween. As shown in FIG. 1, the joint portion *5b* and the joint portion *7b* are symmetrically formed with respect to the center line X—X, so that counterpart joint portions *4b* and *6b* of adjacent sheet piles can be disposed not only at the same side with respect to the center line as shown in FIG. 1, but also at the other side, i.e. in an alternate fashion as shown in FIG. 2. The gap 13 formed between the joint portions *6b* and *7b* which are to be overlapped can absorb the dispersions in rolling results, and moreover, is designed to be from 2 to 10 mm so as to prevent the intrusion of the soil and sand into the interior 8 of the sheet pile through the gap 13 to prevent and the flowing-out of the concrete filled up in the interior 8. Various shapes for the overlap joint portions may be proposed in addition to the shape as shown in FIG. 1, however, it is preferable to adopt ones which are as bisymmetrical as possible in shape to prevent sweep of the stock and the like during the rolling process.

Referring to FIG. 1, projections 14, 15 disposed adjacent the joint portions *5b, 7b* are designed to increase the stability when the sheet piles are stacked in an I shape in cross section and also when the H-sheet piles are driven in with a guide member applied to the outer surfaces of the flanges, and to balance the upper and lower flanges in cross section about a web 3, and to increase the section modulus of the wall of sheet piles.

The abovedescribed steel H-sheet pile is formed at one side thereof with finger joint portions, whereby the workability thereof is high. Further, the steel H-sheet pile is formed at the other side with overlapping joint portions, so that the sheet pile can be integrated with concrete filled up in the interior thereof, thereby enabling the formation of a wall of sheet piles which is excellent in water leakage preventiveness. As will be described hereinafter, the sheet pile is rolled by means of the group of universal mills. As a result it is easy to roll H-sheet piles having a larger height B of the web in cross section, so that the section modulus can be increased.

Description will hereunder be given of an example of the method of producing the steel H-sheet pile according to the present invention in the case the steel H-sheet pile shown in FIG. 1.

Figure 3:
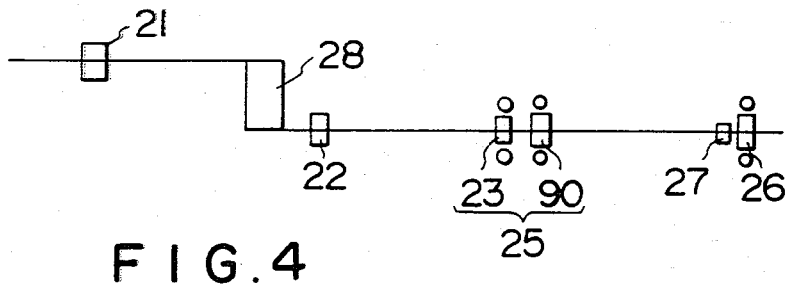
FIG. 3 is a view of layout of the mills in an embodiment of the present invention.

As shown in the layout shown in FIG. 3, the mills for working the present invention include a blooming mill 21, a breakdown mill 22, a group of roughing universal mills 25 consisting of a roughing universal mill 23 and a sizing universal mill 90 and a finishing universal mill 26 and a joint portion bending device 27 directly in front of this finishing universal mill.

Figure 4:
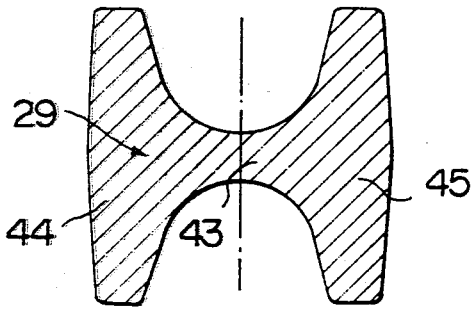
FIG. 4 is a sectional view showing an example of the beam blank being of a H-shape in cross section, symmetrical in vertical and lateral directions in working the present invention.

The blooming mill 21 rolls a beam blank 29 of a H shape in cross section, symmetrical in vertical and lateral directions, which is identical with a beam blank for producing an ordinary H beam well known as shown in FIG. 4. Consequently, a detailed description of this part of rolling method will be omitted. This beam blank 29 may be produced by continuous casting.

Figure 5:
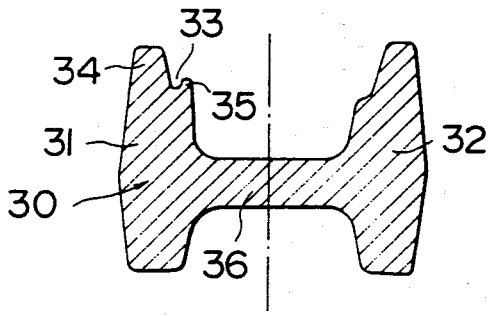
FIG. 5 is a sectional view showing the beam blank rolled by the breakdown mill in the course of the process of the present invention.

The beam blank 29 is heated again in a reheating furnace 28 in a section mill, and then, rolled by the breakdown mill 22 into a beam blank 30 to be subsequently rolled by the group of universal mills 25. As shown in FIG. 5, the beam blank 30 includes flanges 31, 32. The flange 31 at one side is formed at the upper end thereof with a socket 33 corresponding to the socket 9 in the product shown in FIG. 1 and projections 34, 35 corresponding to the projecting pieces 10, 11 of the product shown in FIG. 1. The beam blank 30 is bisymmetrical at the lower end thereof corresponding to the bisymmetrical joint portions 56, 76 of the product shown in FIG. 1. The upper end of the flange 32 at the other side is to be rolled into an overlapping joint portion by the group 25 of the roughing universal mills, and hence, considering the necessary balance in reduction between both flanges when it is rolled by the group of roughing universal mills, the flange 32 has no projecting piece corresponding to the projection 35 formed on the side of the finger joint portion. In addition, in FIG. 5, denoted at 36 is a web. The web 36 is disposed downwardly of the center of the flange width and thus asymmetrical in the vertical direction, and the beam blank 30 is substantially bisymmetrical as a whole in the lateral direction. In other words, the breakdown mill 22 rolls the beam blank 29 symmetrically in the vertical and lateral directions into the beam blank 30 asymmetrical particularly in the vertical direction.

Figure 6:
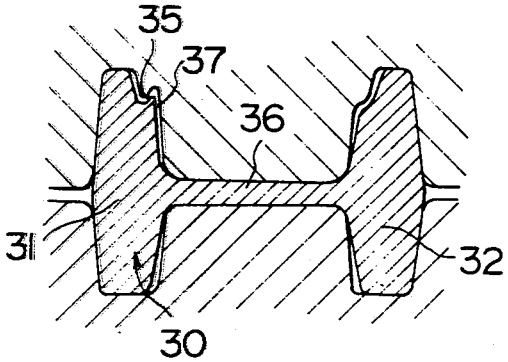
FIG. 6 is a sectional view showing an example of the relationship between the forming caliber of the breakdown mill and the material.

Here, since calibers formed in a breakdown roll are restricted in number, a beam blank 29 symmetrical in the vertical direction should be rolled into a blank beam 30 asymmetrical in the vertical direction by use of calibers in as small as possible a number. If the beam blank 29 is rolled in a plurality of passes by use of an open pass (open calibers) only as shown in FIG. 6, then from the second pass the elongation of the web 36 becomes greater than the elongations of the flanges 31, 32, with the result that the flanges are pulled by the web in the longitudinal direction, the inner surfaces 37 of the flanges are decreased in the thickness-wise directions and the projection 35 is not filled up in the caliber, thereby causing a considerable dispersion to the shapes and dimensions of the projection 35 in the longitudinal direction. During the following rolling process in the group 25 of roughing universal mills, the projection 35 is rolled by a dead hole. Therefore, if the projection 35 is insufficient in its cross-sectional area as described above at the step of the beam blank 30, then the insufficiency in the dimensions is further enchanced, thus causing a considerable dispersion in the dimensions of the projecting piece 11 in the final product shown in FIG. 1. In order to prevent the abovedescribed disadvantage, it is necessary to increase the number of calibers and equalize the elongation ratio of the web to the elongation ratios of the flanges in the respective calibers. However, a roll cannot be formed therein with many calibers, and hence, in order to increase the number of calibers, it is necessary to increase the number of mills.

Figure 7:
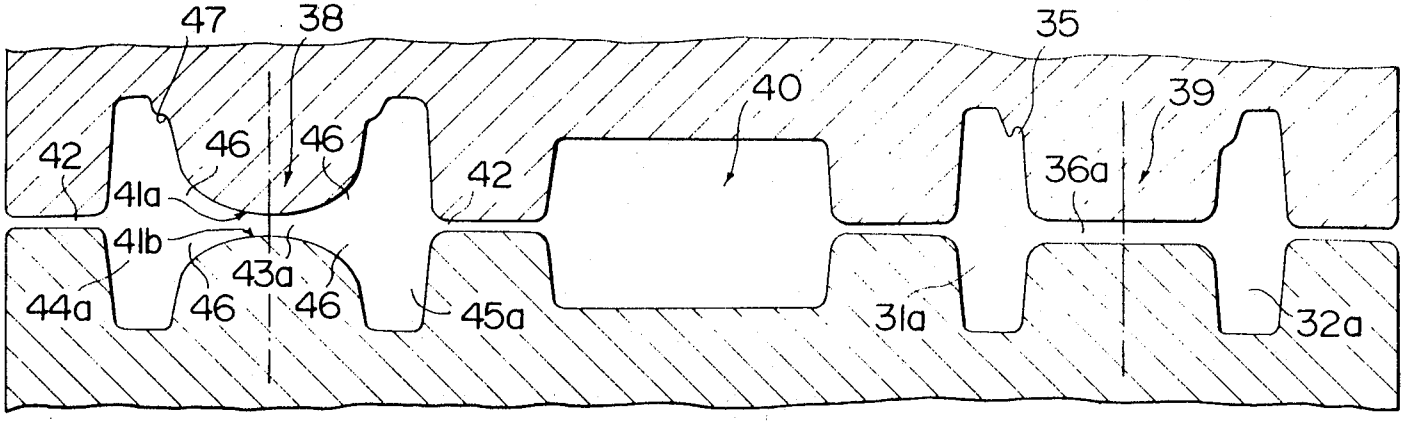
FIG. 7 is a sectional view showing the design of the calibers of the breakdown rolls in working the present invention.

Now, according to the present invention, as shown in FIG. 7, the breakdown mill 22 has rolls formed with a preparatory step forming caliber 38 and another caliber 39. A box pass 40 is provided for correcting an overfill into a gap 42 formed between the rolls when rolling is effected by the preparatory step forming caliber 38, by turning the blank through 90° and passing it through the box pass 40. The beam blank 29 symmetrical in the vertical and lateral directions shown in FIG. 4 is firstly rolled into the beam blank asymmetrical in the vertical direction and substantially bisymmetrical in the lateral direction by use of the preparatory step forming caliber 38 in a plurality of passes. The rolling by the preparatory step forming caliber 38 is performed such that shearing deformation is caused between the web 43 and flanges 44, 45 of the beam blank 29 shown in FIG. 4, whereby the web 43 and the flanges 44, 45 are shifted in their positional relationship. More specifically, the flange portions 44 and 45 of the beam blank 29 symmetrical in the vertical and lateral directions as shown in FIG. 4 are restrained by flange portions **44*a*, 45*a* of the preparatory step forming caliber 38 shown in FIG. 7, and a projection 41*a* of an upper roll of the preparatory step forming caliber 38 pushes the web 43 of the beam blank 29 downwardly, whereby joint portions between the web and the flanges are moved downwardly from the center of the widths of the flanges. In a first pass, where the blank is bitten into this preparatory step forming section 38, a camber and the like may occur to be caused to the blank. However, even if the camber and the like are caused to the blank, the camber and the like can be satisfactorily corrected by manipulators disposed in front and behind the mill, because the temperature of the blank is high and the blank is soft in this state. In this preparatory step forming caliber 38**, the blank is subsequently rolled for a plurality of passes to a predetermined value of web thickness, while making the roll gap smaller pas after pass. For example, the blank is rolled to the value of web thickness of 50 mm within six passes except for the passes where overfills are corrected.

The shapes of root portions 46 of the web portion **43*a* and flange portions 44*a*, 45*a* of the preparatory step forming caliber 38 are formed into shapes which are smooth and have a large radii of curvature, whereby the flow of the metal of the blank is facilitated between the web portion 43*a* and the flange portions 44*a*, 45*a*. Therefore, the metal is reliably filled up in the calibers of the flange portions 44*a*, 45*a***.

The blank, in which its web has been decreased in thickness to a predetermined thickness by means of the caliber 38 and which has been formed into a H-shaped cross section asymmetrical in the vertical direction, is rolled in one to three passes (If there are allowances in the strength of rolls and the motor capacity, one pass is desirable.) by means of the forming caliber 39. If the preparatory step forming caliber 38 is designed to have elongation ratios for the web 36*a* and the flanges 31*a*, 32*a* equal to each other when rolled in the forming caliber 39, then the decreases in thickness of the flanges 31*a*, 32*a* in the forming caliber 39 are lessened, thus enabling one to obtain the cross sections having a low dispersion in the direction of rolling. It is further advantageous to form a preparatory step forming portion 47 in the preparatory step forming caliber 38 so as to facilitate forming of the projecting piece 35 in the forming caliber 39.

As described above, the breakdown mill 22 is provided with the caliber 38 for rolling the beam blank symmetrical in the vertical and lateral directions into one asymmetrical in the vertical direction, so as to regulate the reduction balance of the respective portions of the beam blank during the reduction to be effected in the following forming caliber 39, to thereby obtain a beam blank 30 having the predetermined shape, and can roll the ordinary beam blank 29 symmetrical in the vertical and lateral directions into the beam blank 30 to be fed to the group 25 of the roughing universal mills provided after this breakdown mill 22.

The beam blank 30, which has been rolled by the breakdown mill 22, is sent to the group 25 of the roughing universal mills consisting of the roughing universal mill 23 and the sizing universal mill 90, where it is reciprocatingly rolled in a plurality of passes.

Figure 8:
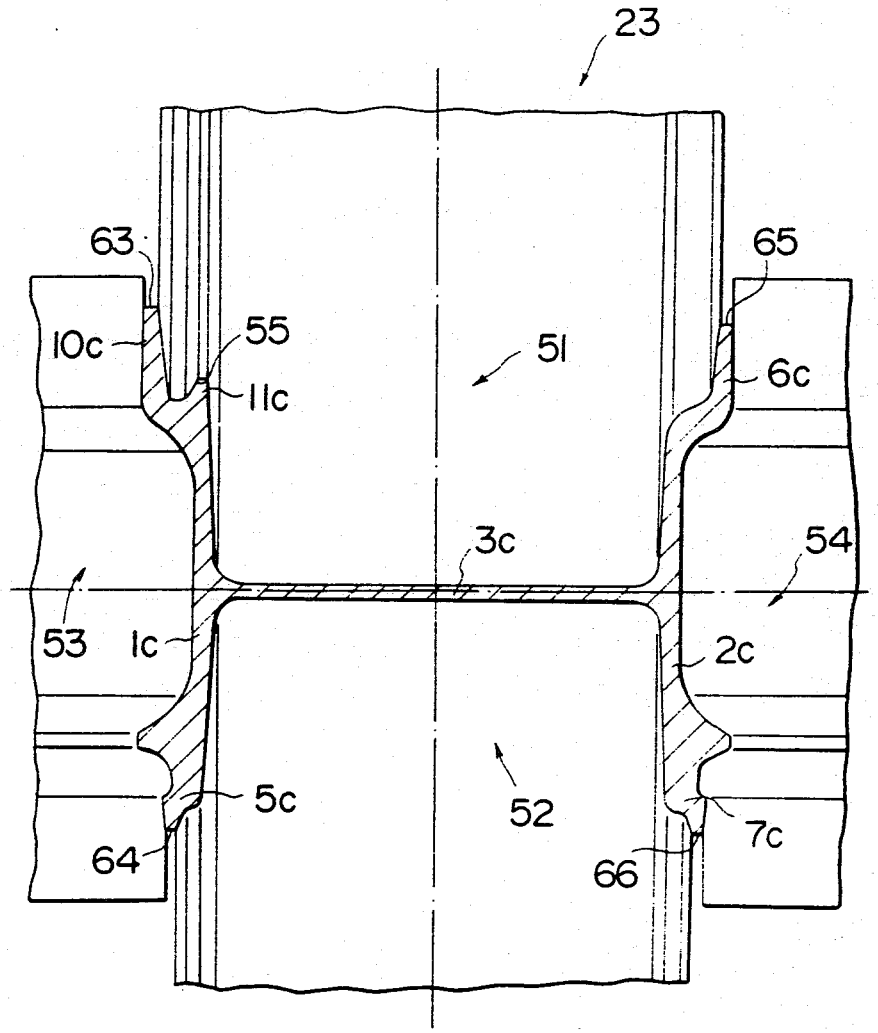
FIG. 8 is a front view showing an example of the essential portions of the roll arrangement of the roughing universal mill in working the present invention.
Figure 9:
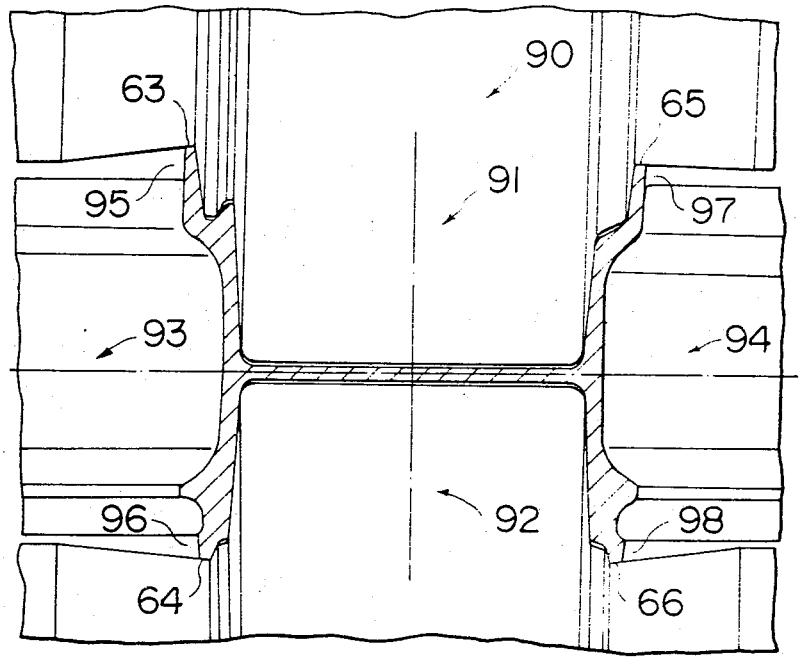
FIG. 9 is a front view showing an example of the essential portions of the roll arrangement of the sizing universal mill in working the present invention.

As shown in FIG. 8, the roughing universal mill 23 includes upper and lower horizontal rolls 51, 52 and vertical rolls 53, 54 disposed to the right and left of the horizontal rolls 51, 52 which roll a web 3*c* using the outer peripheries of the upper and lower horizontal-rolls 51, 52 and flanges 1*c*, 2*c* using the side surfaces of the upper and lower horizontal rolls 51, 52 and the outer peripheries of the vertical rolls 53, 54 in the same manner as in rolling an ordinary H beam. The substantial difference between the rolling of an ordinary H beams and this rolling resides in the rolling of a projection 11*c*, which is formed by a groove 55 formed in the upper horizontal roll 51 during this rolling. A projection 10*c* and other joint portions 5*c*, 6*c* and 7*c* are rolled by the side surfaces of the horizontal rolls 51, 52 and the outer peripheries of the vertical rolls 53, 54 in the same manner as in rolling the flanges 1*c*, 2*c*. The roughing sizing mill 90 (Refer to FIG. 3) disposed behind the roughing universal mill 23 includes an upper horizontal roll 91, a lower horizontal roll 92 and a right and a left vertical rolls 93, 94 as shown in FIG. 9, and mainly size-rolls flange end portions 63, 64, 65 and 66, which have been formed into open ends by the roughing universal mill 23, by means of the upper and lower horizontal rolls 91, 92. Is a result, the thicknesses of the web and flanges are not reduced in principle. The main function of the vertical rolls 93, 94 is to prevent the falling of flanges as will be described later.

Figure 11:
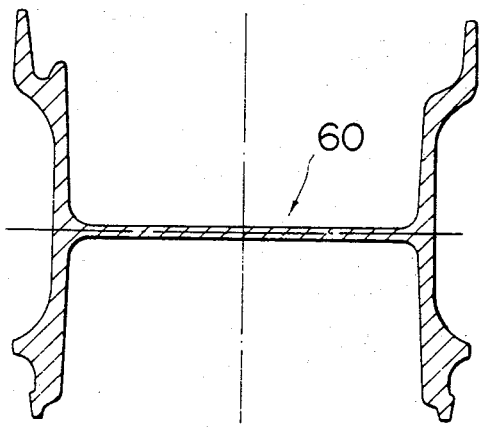
FIG. 11 is a sectional view showing the semi product stock rolled by the group of the roughing universal mills according to the present invention.

The beam blank 30 shown in FIG. 5 is rolled by the roughing universal mill 23 and the sizing universal mill 90 in a plurality of passes as shown in FIGS. 10A through 10F and finally turned into a semi final product 60 as shown in FIG. 11.

The rollings effected by the roughing universal mills 25 are done substantially bisymmetrically, thus causing little sweep to the blanks. Referring to FIG. 8, the projection 10*c* and joint portions 5*c*, 6*c* and 7*c* of the beam blank rolled by the group 25 of the roughing universal mills are extended by being decreased in thickness by the positional adjustments of the vertical rolls during the respective passes in the roughing universal mill 23, and the projection 11*c* is formed by rolling a portion of the blank into the groove 55 formed in the upper horizontal roll 51. However, the reduction acting on this projection 11*c* of the cross section is limited only to the movement of the upper horizontal roll 51, and, since the decrease in the cross-sectional area due to the elongation of the entire cross section in the longitudinal direction of the rolling is greater than the decrease in the cross-sectional area due to the movement of the upper horizontal roll 51, the projection 11*c* tends to be insufficiently filled in the caliber.

Now, this projection 11*c* is easily filled up in the groove 55 by the flow of metal coming from adjacent portions subjected to a high reduction during the first half step of passes where the entire cross section is comparatively large and the degree of freedom for the flow of metal flows in the cross section is high; however, the adverse effect of the decrease in the cross section due to the elongation of the entire cross section becomes greater during the last half step of passes where the degree of freedom for the flow of metal in the cross section comes to be low, thus tending to cause insufficient filling of the projection 11*c* in the groove 55. More specifically, if the reduction of the flanges in value is made greater than the reduction of the web during the first half step of passes where the degree of freedom for the flow of metal is high, then the flanges tend to extend more than the web does. However, since the web and the flanges are integrally formed, the flanges cannot extend alone separately of the web, and the flow of metal occurs in the direction of the width of the flange (the vertical direction in FIG. 8) by the amount prevented from elongation. Consequently, the elongation ratio at the initial state of passes is made large, and thereafter, progressively decreased, whereby it would be possible to fill the groove 55 with the material while reduction is applied to the beam blank by the horizontal rolls 51 is filled up with the material.

According to the various types of experiments made by the present inventor, it has been affirmed that, in order to cause the flow of metal to occur in the widthwise direction of the flange 1*c* during the first half step of passes, it is necessary to make the elongation ratio of the entire cross section of the flanges to be 1.03 times or more higher than that of the web, though it differs depending on the ratio in cross section between the web and flanges. During the step where the flanges are decreased in thickness, the adverse effect of the frictional force between the blank and the roll acting on the surface of the blank reaches to the interior of the flanges, whereby the flow of metal of the blank tends to be affected. A frictional force directed toward the web acts on the internal surface and the projection 11*c* of the flanges due to rotation of the horizontal roll 51, whereby the spreading in the widthwise direction of the flanges is disturbed, so that no advantage can be obtained even if the elongation ratio of the flanges is made greater than that of the web.

Figure 13:
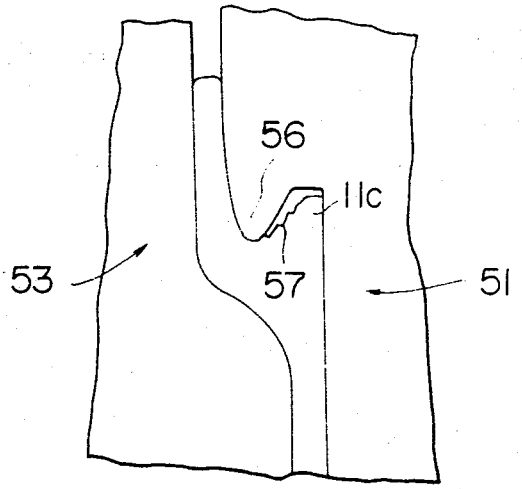
FIG. 13 is a front view showing the essential portions of the rugged step at the foot of the projecting piece 11 of the semi product stock rolled by the roughing universal mill.
Figure 10:
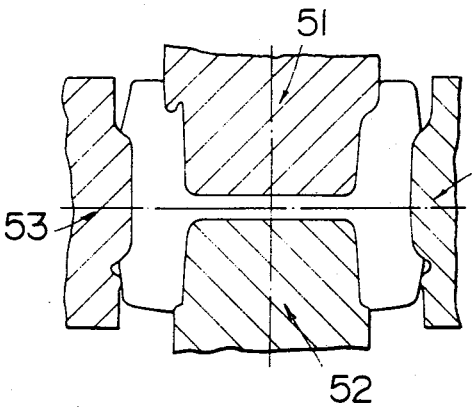
FIGS. 10(A)–10(F) are calibers showing the progress of rolling performed by the group of roughing universal mills according to the present invention.
Figure 10:
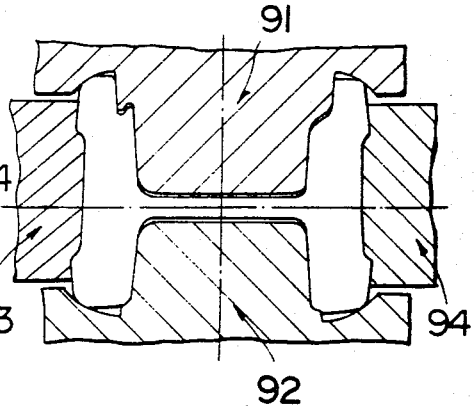
Figure 10:
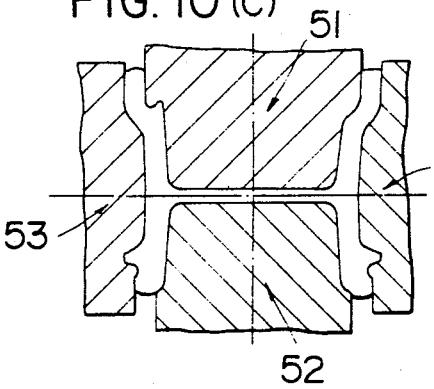
Figure 10:
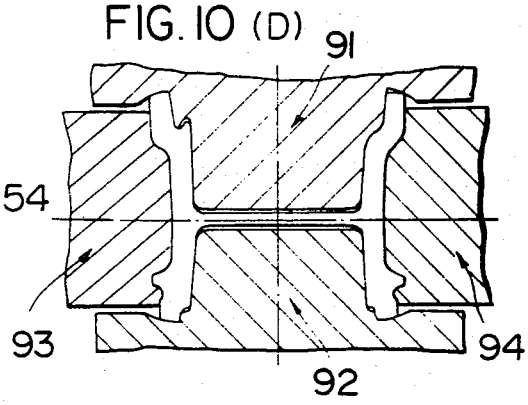
Figure 10:
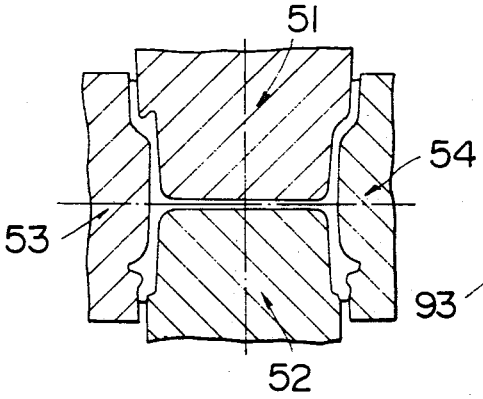
Figure 10:
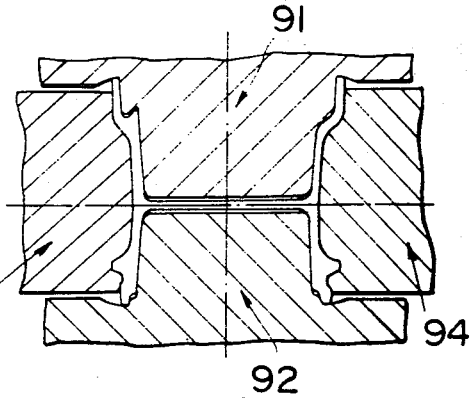
Figure 12:
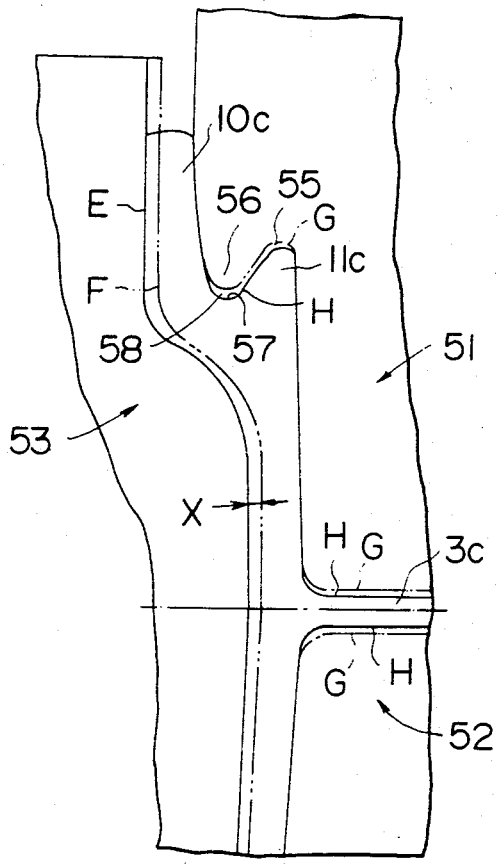
FIG. 12 is a front view showing the essential portions of the mechanism for forming unevenness at the foot of the projecting piece 11 of the semi produce stock rolled by the roughing universal mill.

On the other hand, since the flanges 1*b* , 2*b* of the product of the steel H-sheet pile shown in FIG. 1 is made greater in thickness than the web 3*b* so as to improve the section modulus, if the balance in elongation during rolling is taken into consideration, the rolling reduction on the flanges is constantly greater in value than that of the web during each pass. Consequently, in the roughing universal mill 23, unless the diameter of the vertical roll 53 is made far smaller than the diameters of the horizontal rolls 51, 52, or the axis of the vertical roll 53 is shifted from the axes of the horizontal rolls 51, 52, usually reduction on the outer surface of the flanges by the vertical roll 53 is begun before reduction on the web 3*c* and the forming of the projection 11*c* by the horizontal roll 51 is begun. More specifically, as shown in FIG. 12, at the time E when the vertical roll 53 begins to contact the outer surface of the flange, the horizontal rolls 51, 52 are at the positions G with a gap 58 formed between a projection of roll 56 and the blank, and, by the time H when the projection 56 of the horizontal roll comes into contact with the blank, the outer surface of the flange is reduced to a line F. By this reduction, the foot of the projection 10*c* is pushed into the gap 58 and the projection 11 is also pushed to the right in FIG. 12. The ratio of the value of the projection 11*c* being pushed rightward to the movement X of the vertical roll increases during the last half step of passes where the projection 10 decreases in its thickness, and, in association with the fact that the projection 11*c* tends to be insufficiently filled in the groove 55 during the last half step of passes, a rugged step 57 as shown in FIG. 13 is formed at the foot of the projection 11*c* during every pass. The requirement for high accuracies in the shape and dimensions of the projection 11*c* necessitates taking measures for this rugged step. For this purpose, it is necessary that the contact beginning points between the vertical roll with the blank and the horizontal rolls with the blank are made to draw as close as possible to each other and the value of the reduction X on the flanges is made as small as possible. If the contact beginning points between the vertical roll with the blank and the horizontal rolls with the blank are made to draw as close as possible to each other, then the elongation ratio of the web tends to become greater than the elongation ratio of the flanges because the web is smaller in thickness than the flanges. However, when the elongation ratio of the web becomes greater than the elongation ratio of the flanges, because the web is smaller in thickness than the flanges, the web tends to be disturbed in its elongation by the flanges to thereby cause buckling rather than that pulling of the flanges and extension. On ther other hand, when the reduction on the flanges increases in value, the gap 58 shown in FIG. 12 becomes greater. Consequently, it is preferable that the reduction on the flanges is made as small as possible in value and the reduction by the horizontal roll, i.e., the reduction on the web, is made as great as possible within a range that the elongation ratio of the web does not exceed the elongation ratio of the flanges.

According to the various types of experiments made by the present inventor, it has been affirmed that, if the elongation ratio of the flanges during the last half step of passes is made 1.15 or less per pass, then the difference between the elongation ratio of the projection 11*c* and that of the remaining portion becomes smaller in absolute value and the reduction by the vertical roll 53 becomes smaller, so that disadvantages including a decrease of the projection 11*c* in thickness and the rugged step at the foot thereof can be obviated to a considerable extent. Further, if the ratio between the elongation ratio of the flanges and the elongation ratio of the web is set at 1.0~1.03, then the gap 58 shown in FIG. 12 becomes smaller and the advantage of improving the rugged step is further enhanced. It has been affirmed that, on the contrary, if the elongation ratio of the flanges is set at 1.15 or more and the elongation ratio of the web at 1.03 or more, then the projection 11*c* becomes far worse in shape after rolling As described above, during the first half step of passes the elongation ratio of the flanges is preferably made far greater than the elongation ratio of the web to promote the flow of metal in the widthwise direction of the flanges; however, on the contrary, during the last half step of passes, the elongation of the flanges is preferably controlled to the utmost, to thereby cause the elongation ratio of the web and the elongation ratio of the flanges to draw as close as to each other. The mean value of the total number of the passes performed by the group of the universal mills may be regarded as the borderline between the first and last half steps of passes, and the elongation ratio of the flanges is preferably decreased with the number of passes. Table 1 shows an example of the pass schedule.

TABLE 1

| | Example of Pass Schedule in Group of Universal Rolling Mills | | | | |
|---|---|---|---|---|---|
| Pass No. | Average thickness of web 50 mm | Average thickness of flange 158 mm | Elongation ratio of web | Elongation ratio of flange | Elongation ratio of flange / Elongation ratio of web |
| 1 | 48 | 146 | 1.042 | 1.082 | 1.039 |
| 2 | 44 | 129 | 1.091 | 1.132 | 1.037 |
| 3 | 39.6 | 112 | 1.111 | 1.152 | 1.037 |
| 4 | 35.6 | 97 | 1.112 | 1.155 | 1.038 |
| 5 | 31.9 | 84 | 1.116 | 1.155 | 1.035 |
| 6 | 28.5 | 72.8 | 1.119 | 1.154 | 1.031 |
| 7 | 25.5 | 63.2 | 1.118 | 1.152 | 1.031 |
| 8 | 22.9 | 55.2 | 1.114 | 1.145 | 1.028 |
| 9 | 20.6 | 48.5 | 1.112 | 1.138 | 1.024 |
| 10 | 18.6 | 42.8 | 1.108 | 1.133 | 1.023 |
| 11 | 16.8 | 37.9 | 1.107 | 1.129 | 1.020 |
| 12 | 15.2 | 33.7 | 1.105 | 1.125 | 1.018 |
| 13 | 13.8 | 30.1 | 1.101 | 1.120 | 1.016 |
| 14 | 12.6 | 27.1 | 1.095 | 1.111 | 1.014 |
| 15 | 11.6 | 24.6 | 1.086 | 1.102 | 1.014 |
| 16 | 10.8 | 22.6 | 1.074 | 1.088 | 1.013 |
| 17 | 10.2 | 21.1 | 1.059 | 1.071 | 1.012 |

Even if the measures as described above are taken, as the final pass approaches, the projection 11*c* is insufficiently filled in the groove 55 of the roll 51 and formed at the foot thereof a rugged step more or less. Hence, it is preferable that the curve formed at the forward end of the projection 56 of the upper horizontal roll is made when the rugged step is inconspicuous even if the step may be formed thereon. The contour of the cross section of the projection 11*c* after the final pass is substantially analogous to the contour of the cross section of the groove 55, and the cross-ectional area thereof was substantially 7/10 of the cross-sectional area of the groove 55 in the embodiment, though it varies depending on the difference in elongation ratio between the projection 11*c* and the remaining portion. Consequently, if the shape and the dimensions of the groove 55 are made to take the abovedescribed decrease into account, then the aimed for shape and dimensions may be obtained after the rolling process.

More particulary, according to the present invention, in reversingly rolling the beam blank in a plurality of passes by means of the group of roughing universl mills including a roughing universal mill and a sizing mill, during the first half step of passes the elongation ratio per pass of the flanges as a whole is 1.03 times or more than the elongation ratio of the web, during the last half step of passes 1.03 times or less, during the last half step of passes the elongation ratio per pass of the flanges is set at 1.15 or less, the projection pieces are rolled into ones having the aimed for shape and dimensions by means of the caliber, and the malformation can be prevented and the accuracy of dimensions can be improved.

In rolling the beam blank by the group 25 of the roughing universal mills as described above, the sizing universal mill 90 forms the projection 10*c* and the forward ends 63, 64, 65 and 66 of the joints 5*c*, 6*c* and 7*c*, all of which were not brought into contact with the rolls in the roughing universal mill 23 as described hereinbefore and shown in FIG. 8.

Vertical rolls 93, 94 are formed such that they are interposed between the horizontal rolls 91, 92 to effect reduction on the outer surface of the flanges except for the forward ends thereof. The forward ends 63, 64, 65 and 66 of the joint portions at the ends of the flanges, which have not been in contact with the rolls in the universal mill 23 are size-rolled by the horozintal rolls 91, 92 of the universal mill 90. At this time, the vertical rolls 93, 94 mainly aim at preventing the flanges from falling to the outer side, and, in principle, no active reduction on the flange is effected. However, a light reduction of 10% or less may be effected for the purposes of decreasing the number of passes and improving the prevention of falls. If a re uction more than the above is effected, then the forward ends will bulge out into roll gaps 95, 96, 97 and 98 and the reduction on the forward ends by means of the vertical rolls of the universal mill during the succeeding passes is increased in value, thereby resulting in unstable shapes and dimensions of the forward ends. The abovedescribed size-rolling method may be applied not only to the case in which two universal mills are continuously disposed as in this embodiment but also to the case when three or more universal mills are continuously disposed for unidirectional or reciprocating rolling and one or more of the universal mills are used for size-rolling the forward ends of the flanges.

The semi-final product, which has been subjected to rolling passes as shown in FIGS. 10A through 10F and rolled to the cross-sectional shape 60 as shown in FIG. 11 in the group 25 of the roughing universal mills, is finally rolled by the finishing universal mill 26 and a joint forming apparatus 27.

Figure 14:
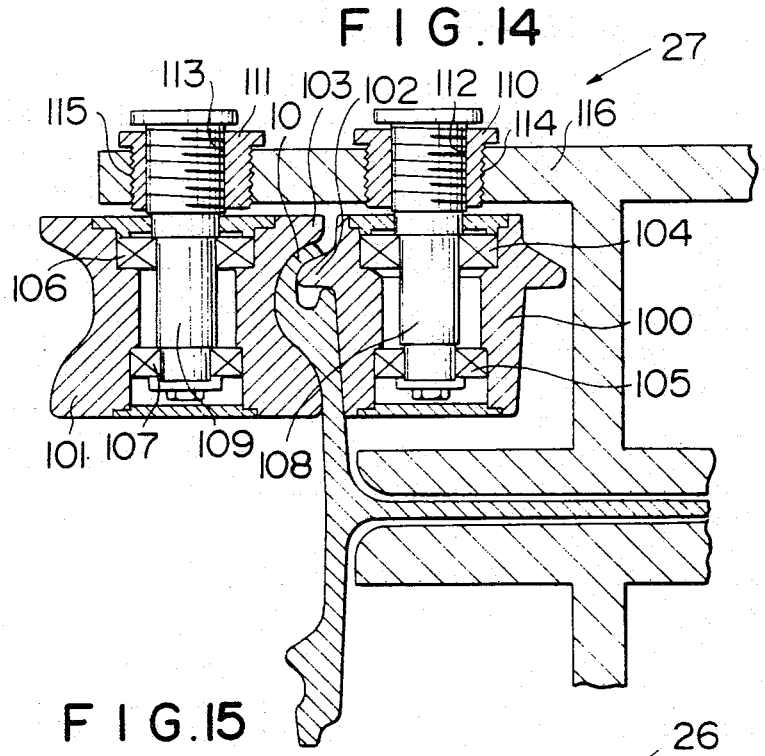
FIG. 14 is a sectional view showing the joint forming device according to the present invention.

As shown in FIG. 14, the joint forming apparatus 27 includes an inner roll 100 having a ridge 102 for determining a bending position for the projecting piece 10 and an outer roll 101 having a ridge 103 for pressing and bending the projecting piece 10. The rolls 100, 101 can rotate about rotary shafts 108, 109, respectively, through bearings 104, 105, 106 and 107 and are solidly secured to the shafts so as not to move in the axial direction of the rotary shafts. A composite bearing between a radial bearing and a thrust bearing and a conical roller bearing are preferably used as the bearings 104, 105, 106 and 107 because these bearings are subjected to load acting on the roll in the radial and axial directions. Threads are formed on the outer peripheries of ends of the shafts 108, 109, and engage with the internal threads of nuts 110, 111. Threads 114, 115 having centers of threads different from those of the internal threads are formed on the outer pripheries of the nuts 110, 111 are threadably coupled to threaded portion provided on the main body 116 of the apparatus so that the rolls can be open-sidedly supported by the main body. Consequently, the positions of the rolls 100, 101 in the axial direction can be adjusted such that the shafts 108, 109 are rotated by means of the threads to move in the axial directions thereof, and the movements of the rolls in the radial directions can be obtained such that the centers of the shafts 108, 109 are moved about the centers of the external threads 114, 115 of the nuts 110, 111. This apparatus, being simple in mechanism, can be rendered compact, and easily solidly secured to a rest bar or the like in front of a mill. By securing this apparatus with the rolls for bending the joint portions, the accuracy in bending the joint portions can be improved to a considerable extent. In this embodiment, two sets of the rolls are continuously provided to carry out the bending work in two steps; however, the number of steps of bending can be increased to further improve the accuracy of bending.

Figure 15:
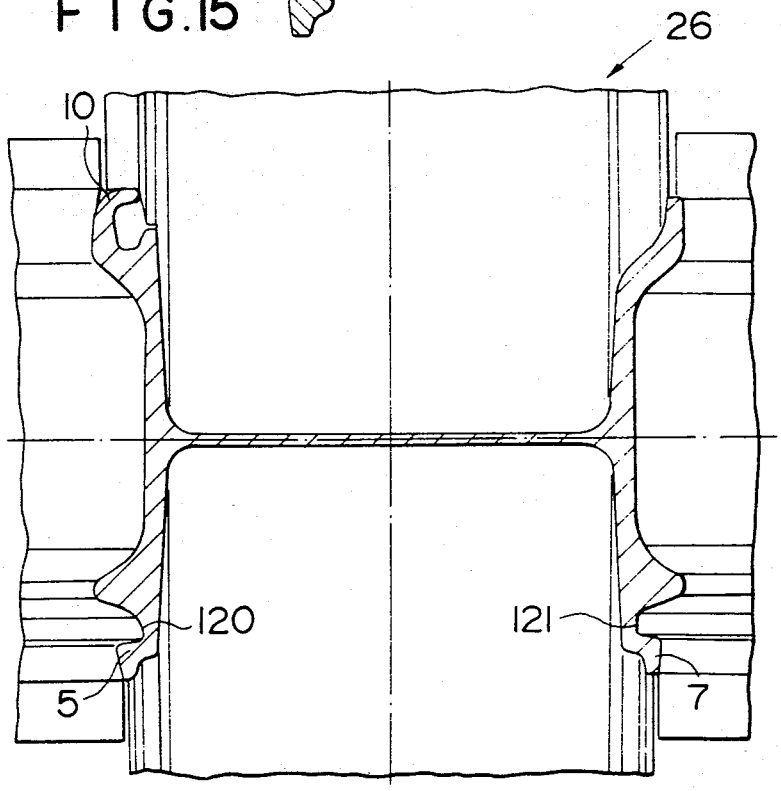
FIG. 15 is a front view showing an example of the essential portions of the roll arrangement of the finishing universal mill.

The semi-final product, whose projecting piece 10 is bent in the joint forming apparatus 27, is regulated in its contour in the finishing universal mill 26 as shown in FIG. 15. At this time, constrictions 120, 121 required for the joint portion forming the pivot are formed.

Through the abovedescribed process, the steel H-sheet pile has been rolled in this embodiment. Such a version may be thought of that two or more groups 25 of the roughing universal mill in this embodiment are used; however, the arrangement in this embodiment is so satisfactory that the steel H-sheet pile can be efficiently and highly accurately rolled with the minimum number of the mills.

According to the conventional method as disclosed in Japanese Patent Kokai(Laid-Open) No. 11061/79, a process has been shown that, after roughing-rolling is effected by a roughing universal mill and a roughing sizing mill having two-stage caliber rolls, size-rolling is performed by an intermediate universal mill and an intermediate sizing mill, and thereupon, the final finishing is effected by a finishing universal mill. In contrast thereto, according to the present invention, rolling is performed by a group of the roughing universal mills consisting of a roughing universal mill and a sizing universal mill, so that a satisfactory shape can be obtained without an intermediate universal mill as described in the reference cited. Moreover, the joint portion bending device is provided in front of the finishing universal mill, thereby eliminating the need for the intermediate sizing mill as described in the reference cited.

As a result, according to the invention of the present application, a steel pile can be rolled by an installation having fewer number of stands than in the case of the reference cited. Although the finger bending by use of the joint portion bending device according to the invention of the present application requires by far a smaller installation cost as compared with the finger bending by use of the intermediate sizing mill described in the reference cited, the finger bending according to the invention can be effected with far higher accuracy than in the case of reference cited.

According to the present invention, a steel H-sheet pile having a high section modulus and excellent in workability and water leakage preventiveness can be efficiently and accurately produced by means of rolling equipment identical with those used in rolling ordinary H beams and a small number of additional apparatuses.

The additional apparatuses for use in rolling this steel H-sheet pile and the method of rolling same may be applied to the production of other shapes of steel having flanges.

It should be apparent to one skilled in the art that the abovedescribed embodiments are merely illustrative of but a few of the many possible specific embodiments of the present invention. Numerous and varied other arrangements can be readily devised by those skilled in the art without departing from the spirit and scope of the invention.

What is claimed is:

1. A method of producing a steel H-sheet pile from a beam blank of an H-shape cross section defined by a web and a pair of flanges on both ends of the web symmetrical in vertical and lateral directions, said beam blank prepared through blooming rolling or continuous casting, said method comprising the ordered steps of:

(a) rolling the beam blank in a breakdown mill having a preparatory step forming caliber and a forming caliber, said rolling step comprising the steps of:

shifting the positional relationship between the web and flanges in said preparatory step forming caliber so as to roll the beam blank into an asymmetrical shape in its vertical direction by moving the web in one vertical direction while restraining the flanges in their positions; and subsequently forming roughly a finger joint portion having a longer projection piece and shorter projection piece at one end of one of said flanges in said forming caliber;

(b) further rolling the beam blank roughly formed in said breakdown mill in a group of roughing universal mills including a roughing universal mill and a sizing universal mill, said further rolling step comprising the steps of:

reducing the thickness of the web and flanges of the beam blank by said roughing universal mill; and sizing the end portions of the flanges while supporting the flanges so as to prevent the flanges from falling down, said sizing step being performed by horizontal rolls of said sizing universal mill and said supporting step being performed by vertical rolls of said sizing universal mill;

(c) forming said finger joint portion at the end of one of said flanges by a joint forming device having first and second rollers without using any intermediate mills, said forming step being performed by bending said longer projection piece by a first forming ridge on said second roller while limiting the bending position of said longer projection piece by pressing said longer projection piece against a second forming ridge on said first roller; and (d) completing the forming of the beam blank to provide the steel H-sheet pile by rolling said blank in a finishing universal mill.

2. A method fo producing a steel H-sheet pile as set forth in claim 1, wherein rolling in the roughing mill is effected such that the rate of elongation of the flanges is high at the initial stage, and thereafter, progressively lowered whereby the flow of metal in the widthwise direction of the flanges is promoted.

3. A method of producing a steel H-sheet pile as set forth in claim 1, wherein the outer surfaces of the flanges are pressed by the vertical rolls of the sizing universal mill at a reduction ratio of 10% or less.

4. A method of producing a steel H-sheet pile as set forth in claim 1, wherein said bending of the joint portion is divided into at least two steps.

* * * * *